US007540752B1

(12) United States Patent
Tucker

(10) Patent No.: US 7,540,752 B1
(45) Date of Patent: Jun. 2, 2009

(54) HIGH CONDUCTOR DENSITY CONNECTOR FOR ZERO TRANSMITTED FORCE ENGAGEMENT

(76) Inventor: Timothy J. Tucker, 11930 Research Cir., Alachua, FL (US) 32615

( * ) Notice: Subject to any disclaimer, the term of this patent is extended or adjusted under 35 U.S.C. 154(b) by 0 days.

(21) Appl. No.: 12/012,892

(22) Filed: Feb. 6, 2008

(51) Int. Cl.
*H01R 11/22* (2006.01)

(52) U.S. Cl. ..... 439/267; 439/909; 439/269.1; 439/822

(58) Field of Classification Search ..... 439/260, 439/267, 269.1, 377, 632, 635, 822, 909
See application file for complete search history.

(56) References Cited

U.S. PATENT DOCUMENTS 5,402,316 A * 3/1995 Volz et al. ..... 361/785
5,454,739 A * 10/1995 Strand ..... 439/729
5,549,479 A * 8/1996 Elco et al. ..... 439/67
5,730,619 A * 3/1998 Hamlin ..... 439/493
6,027,363 A * 2/2000 Watt et al. ..... 439/456
6,030,243 A * 2/2000 Harting et al. ..... 439/260
6,042,410 A * 3/2000 Watanabe ..... 439/269.1
6,053,746 A * 4/2000 Yoshizawa ..... 439/67
6,394,953 B1 5/2002 Devlin et al.
6,415,168 B1 7/2002 Putz
6,857,908 B2 * 2/2005 Burmeister ..... 439/632
7,374,088 B2 * 5/2008 Perben et al. ..... 235/441

* cited by examiner

*Primary Examiner*—Renee S Luebke
*Assistant Examiner*—Larisa Tsukerman
(74) *Attorney, Agent, or Firm*—Sven W. Hanson

(57) ABSTRACT

A releaseable multi-channel electrical connector is designed for small size, and ease of use without generating manipulation forces that might be transmitted to an attached living subject. Two pivoting frame members on which electrical snap connectors are mounted are oriented such that the two snap connectors face a male connector element placed between the two frames. The male connector includes mating snap connectors on opposing sides that join with the snap connectors on the frames when the frames are squeezed together. Because two frames are squeezed together with opposing forces to make a connection, no net force is generated or transmitted to the male element nor to attached subject bodies. The use of two snap connectors on opposing sides on a single male element increases the conductor density over prior devices.

12 Claims, 5 Drawing Sheets

HIGH CONDUCTOR DENSITY CONNECTOR FOR ZERO TRANSMITTED FORCE ENGAGEMENT

RELATED APPLICATIONS

None.

BACKGROUND OF THE INVENTION

The present invention pertains to multiple conductor electrical connectors, particularly electrical connectors providing both high density and high number of conductors. Most particularly, the invention is a three-piece pivoting frame which is operated to retain and manipulate two sets of conductors to connect with both sides of an inserted two-sided connector body. The novel combination of the frame and two-sided geometry provides novel benefits including unconventionally high density and zero net force connection and disconnect operations.

In many applications such as clinical neurological testing of animals, there is often a need for electrical devices with large numbers of distinct electrical circuits and hence equally large numbers of electrical conductors. For many reasons, it is desirable for these conductors to be very small and, in the aggregate, to take up very little space. Particularly in medical research and clinical fields, it is also desirable to provide conductor connectors that enable portions of electrical systems, such as implanted neurological monitoring devices, to be disconnected and reconnected from other system components. There are a great variety of high density conductor connectors developed in the past for these purposes. However, the need for yet higher density and higher numbers of circuits and conductors remains.

A separate, yet related, issue with electrical connectors in the medical research field concerns the incidental forces transmitted when connectors are joined or separated. In most applications outside of the medical field, and many within, these forces are not relevant. However, where electrical devices are implanted into live animal or human subjects, forces used in manipulating the devices and the attached systems components may be critical. Particularly where the subjects are small animals, such as the small mammals that are often used in medical research studies, the ability to disconnect and reconnect implanted devices without transmitting forces to the subject may be critical to survival of the subject and success. Prior high conductor density electrical connectors do not satisfy these requirements. What is desired is a high conductor density electrical connector that may be joined and separated multiple times without transmitting forces to the connected conductors.

SUMMARY OF THE INVENTION

The present invention is a releaseable multi-channel electrical connector designed for small size and ease of use without generating manipulation forces that might be transmitted to an attached subject. The inventive design uses two pivoting frame members on which electrical snap connectors are mounted. The frames are oriented such that the two snap connectors face a male connector element placed between the two frames. The male connector includes mating snap connectors on opposing sides that join with the snap connectors on the frames when the frames are squeezed together. Because the frames are squeezed together to make a connection, no net force is generated or transmitted to the male element nor to attached subject bodies. The use of two snap connectors on opposing sides on a single male element increases the conductor density over prior devices.

In order to ensure registration of the mating snap connectors before connection is attempted, a center registration frame is provided to receive and locate the male element. The pivoting frames, and registration frame, together form a tapered receptacle which eases entry of the male element. The condition is enhanced by preferably biasing the pivoting frames open. This geometry enables users to join the two portions of the connector with reduced "fumbling" or incidental motion or applied forces by the user. The result is reduced potential damage to any connected subject.

To ensure both easy engagement and secure registration of the two mating connector parts, tapered grooves in a registration frame are mated with tapered posts in a male element. The taper angle of the male element is greater than the receiving groove to provide a combination of a relatively large transverse gap between them at first introduction, and tight fit at registration.

The pivoting frames include handle portions provided for easy disconnection of the device. By squeezing the handle portions together, the snap connectors are both separated from the male connector element without any net forces transmitted through the device.

One aspect of the invention is a reusable high conductor density connector of small size that is applicable for use on small animal subjects.

A further aspect of the invention is a high density connector that enables connection and disconnection operations with zero net force applied to the connector components.

Additional novel aspects and benefits of the invention will be discerned from the following description of particular embodiments and the accompanying figures.

DETAILED DESCRIPTION OF EMBODIMENTS OF THE INVENTION

Figure 1:
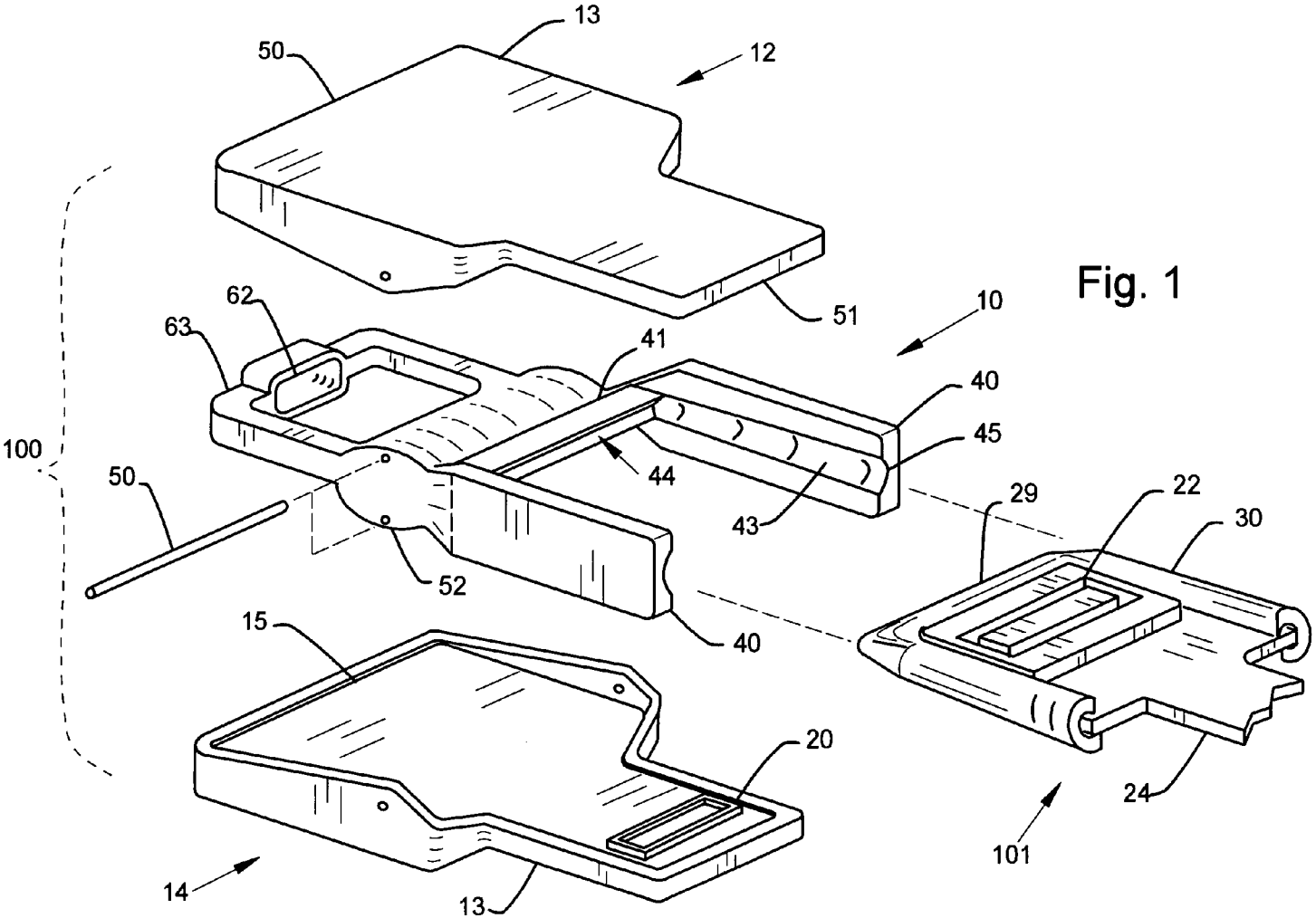
FIG. 1 is an exploded perspective view of a preferred embodiment of the inventive connector.

FIG. 1 is an exploded perspective view of a preferred embodiment of the inventive connector. The immediately following is a general description of this embodiment and its basic components and their relations. The connector includes a female connector assembly element 100 of multiple parts that move relatively, to physically and electrically engage and disengage a male connector element 101. The female element 100 includes a rigid register frame 10 configured to receive and relatively position the male element 101. The female element 100 also includes both an upper and lower frame 12, 14 that are each pivotably connected to opposite top and bottom sides of the register frame 10. Each frame 12, 14 includes an insulating cover 13 and retained circuit board (CB) 15 on which is mounted a female portion 20 of an electrical "snap" connector.

The male element 101 is formed by an elongated CB 24 and a hood frame 30 that covers one end of the elongated CB 24. A mating, male, portion 22 of the electrical "snap" connector is mounted on one face of the elongated CB 24. An identical second male connector portion 22 is mounted on the opposite face (not visible in this figure).

The hood frame 30 is configured to be received by, and engage with, the register frame 10. The frame elements 10, 12, 14 are appropriated configured, and the respective portions of the snap connector are likewise mounted on the associated CBs, to ensure that the frame elements may be operated to alternatively connect and disconnect the snap connectors to, respectively, establish and break electrical circuits through the female and male connector elements.

The functional requirements and details of the various elements of the inventive connector will now be discussed. In the inventive device, two snap connectors are used, simultaneously, to maximize conductor density. The terms "conductor density" herein generally means the number of distinct and parallel, or otherwise simultaneous, electrical conductors providing distinct circuit paths passing through an area. High conductor density means a high number of distinct conductors provided passing through an area, or across a linear dimension, on a circuit board, or on the effective contact area of a connector. High conductor density is necessary to provide both high numbers of data signals and small physical size. In the specific applications used as examples herein, high conductor density means at least 60 conductors or contacts per linear inch of surface on a connector body or connected device.

The design and operation of the inventive connector are directed at providing high conductor density, particularly in a small connector size. In medical research applications, it is desired to monitor a large number of physiologically originating signals (such as brain neural signals) in small test animals. For these applications, 16 to 64 channels of data are often needed, and at times many more channels are desired. Due to the small size and relatively fragile nature of the animals used in these tests, small connector size (therefore weight also) is needed to reduce damage to the test animals during test procedures—particularly when connecting and disconnecting signal circuit leads. This results in a large number of conductors (to provide the channels of data) in a small device.

To provide high conductor density, the present invention preferably uses an arrangement of two simultaneous multi-conductor snap connectors. A snap connector as used herein is typified by devices often used in the consumer electronics industry to permanently connect conductors in assembly of electronic devices such as cellular phones and computers. Such connectors have two releaseable mating portions with an array of multiple metallic contacts. In particular, such a snap connector is defined by the example of the products sold by the Hirose Electric Company, Ltd. (Japan) and Hirose Electric Inc. (U.S.A.) under the product designation DF30, and similar devices. These are surface-mounted devices with a height dimension (above the mounting surface) of 0.90 mm (millimeters) and a contact center-to-center spacing of 0.4 mm. Prototype inventive devices having 16 to 64 channels (usable conductors) have been made using the respective Hirose DF30 devices.

Figure 2:
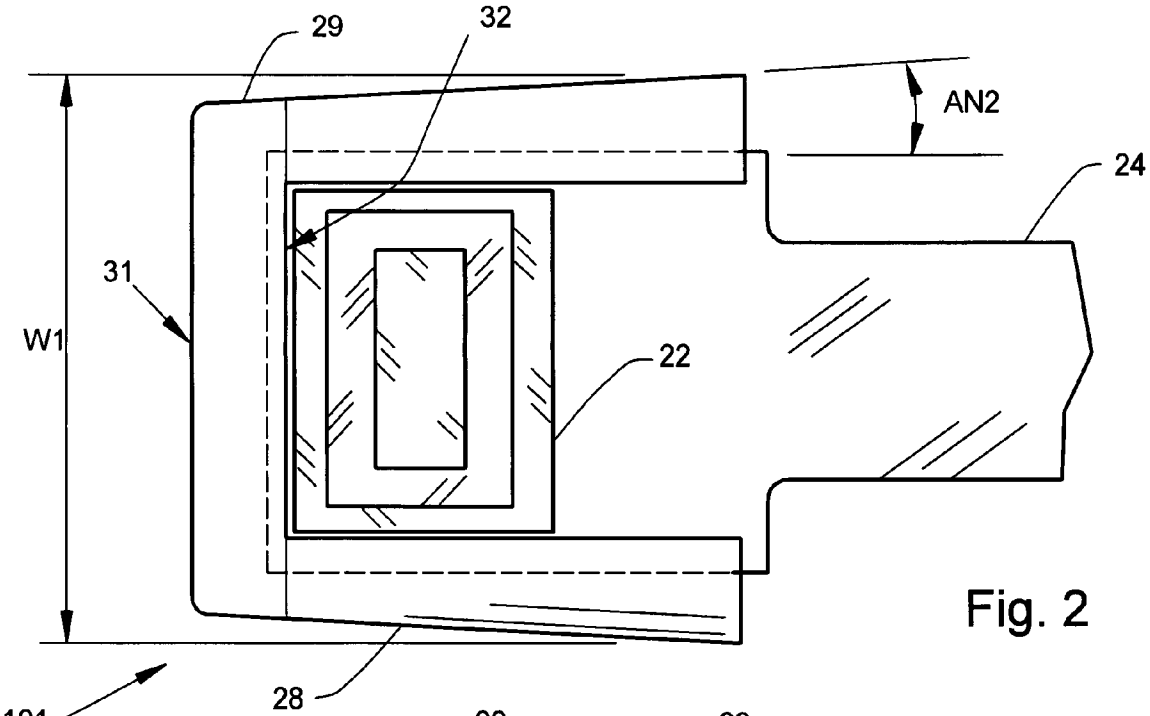
FIG. 2 is a top view of a male element of the invention.
Figure 3:
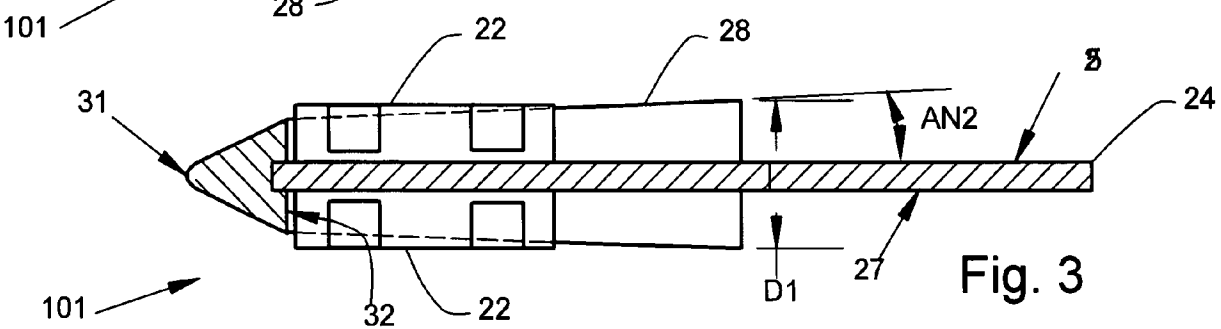
FIG. 3 is a side section view of the male element of the invention.

FIGS. 2 and 3 illustrate the position and arrangement of the snap connectors on the male element 101 of the inventive connector. Male snap connector portions 22 are mounted on each of the top face 25 and bottom face 27 of the elongated CB 24. The two male snap connector portions 22 are preferably located on a common centerline and identically oriented. In this manner, when the female and male elements 100, 101 are joined and the respective snap connector portions mated, a minimum of external torque or unbalanced reaction forces are generated or applied to the male element. The male snap connector portions 22 are connected and secured to the elongated CB in the conventional manner. Electrically, the male snap connector portions 22 are connected to the elongated CB 24 via solder joints formed at conductive points on the male snap connector portion 22, and bridging to electrically conductive lands on the elongated CB 24. This is carried out in the conventional manner. The lands, and associated electrical circuit elements, are provided in the construction of elongated CB 24 in conventional fashion. The combination of two snap connectors on the single male element 101 enables doubling the conductor density of the male element as twice the number of conductors and circuits are provided through the cross-section of the elongated CB 24.

The hood frame 30 is positioned relative to the male snap connector 22 when mounted on the elongated CB 24 to allow the hood frame 30 to be used to establish relative positioning of the male snap connector 22 during engagement with the female element. The hood frame 30 is formed in part by side posts 28 that, when assembled with the elongated CB 24, surround and securely envelope the side edges of the elongated CB 24. The shape of the side posts 28 is generally a side-truncated cone. The side posts 28 are connected by, and integral with, a hood leading edge portion 29. The leading edge portion 29 has a leading edge surface 31 and abutting surface 32 which together establish the position of the male snap connection portions 22 during engagement and registration with the female element 100. The abutting surface 32 is configured to accept and bear securely on a flat side surface of the male snap connector portions 22 to establish their relative locations. As such, the longitudinal dimension, and relative angle, between the leading edge surface 31 and the abutting surface 32 is critical and tolerances must be controlled to ensure proper alignment. This aspect is discussed further below.

In the female connector element 100, the register frame 10 initially engages the male element 101 to establish a position that enables functional connection of the device. The register frame 10 has two generally parallel rigid arms 40 that are joined at one end by a rigid frame base 41. Each arm has a longitudinally oriented receiving groove 43 that is generally configured to received a hood frame side post 28, such that the male connector element 101 may be positioned with its opposing side posts 28 in a respective receiving groove 43. The grooves must be spaced apart and oriented to match the hood frame 30. The side posts 28 slide within the grooves 43 as the leading edge portion 29 is advanced into the registration frame 10. Initially, when the two elements are first brought together, the gap between these elements is relatively large, and progressively lessens as the male element 101 is further advanced into the registration frame 10. When fully engaged in the register frame 10, the hood frame leading edge portion 29 contacts a registration surface 44 in the frame base 41.

The registration surface 44 extends the full width of the frame base 41, to match the leading edge portion 29 and leading edge surface 31 of the male element 101. When fully engaged, the registration surface 44 centers and maintains the position of the leading edge portion 29 in the vertical direction. This is desired due to the vertical gap, and therefore lack of support, between the grooves 43 and side posts 28 near the frame base 41.

Figure 4:
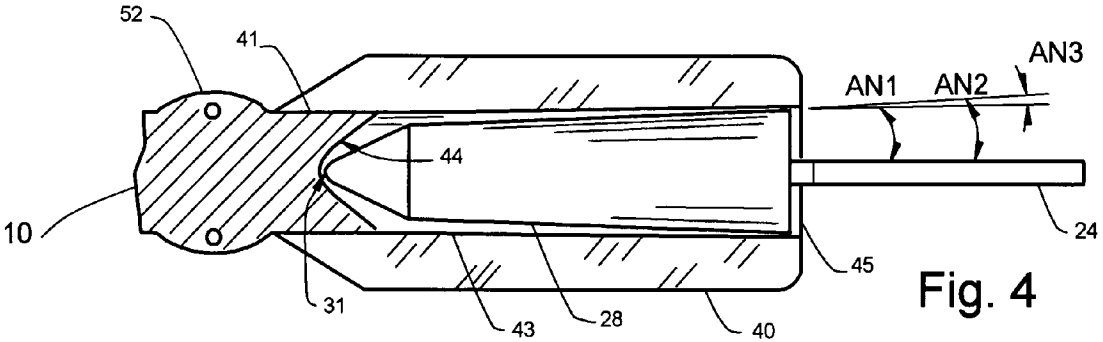
FIG. 4 is a partial side longitudinal section view of the assembled components of the preferred embodiment.
Figure 5:
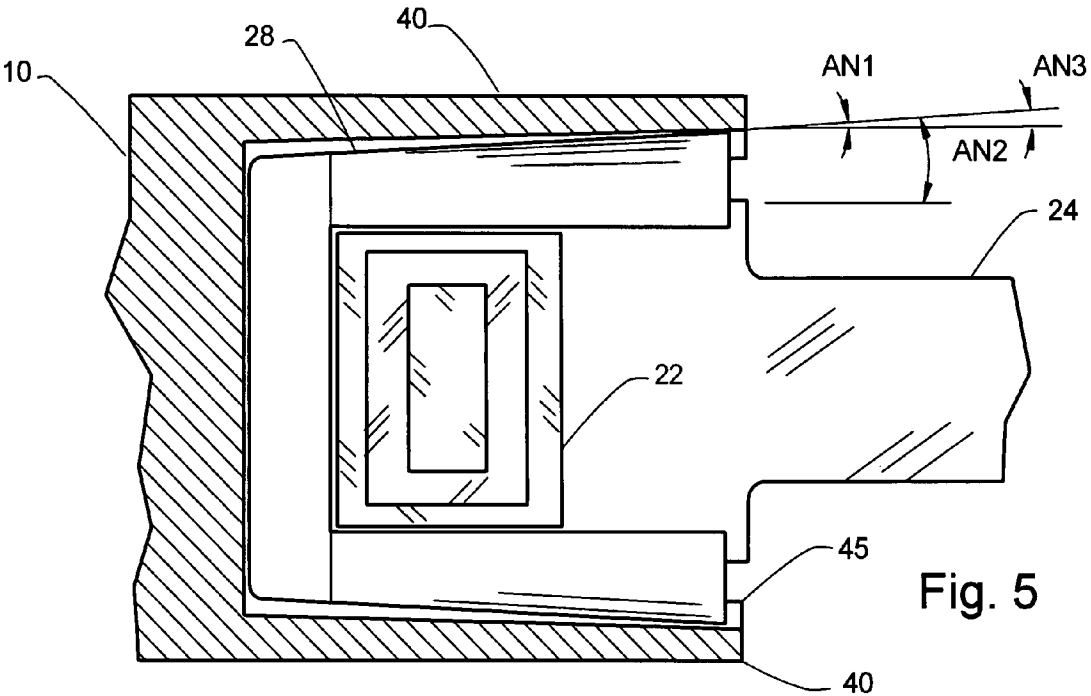
FIG. 5 is a partial top longitudinal section view of the assembled components of the preferred embodiment.

FIGS. 4 and 5 depict the engaged condition of the connector elements in a partial longitudinal section views. In FIG. 4, to enhance clarity, the male element snap connection portions are not shown. Also, the leading edge surface 31 is shown slightly separated from the registration surface 44, while in fact the two surfaces contact during full engagement.

Each groove 43 has an axis-symmetric half-cone angle AN1 (relative to its central long axis) slightly smaller than the respective draft angle AN2 of the hood frame side posts 28. The difference between these two angles defines a gap angle AN3 which is preferably in the range of 0.5 to 1.5 degrees. This geometry provides both easy insertion of the male element 101 and control of its registration location with tight tolerance. Easy insertion is also a result of the smaller dimensions (width and diameter) of the hood frame 30 and side posts 28, adjacent the leading edge 30, as compared to the registration frame 10 and grooves 43. A half-cone angle AN1 of 1.5 degrees and a draft angle AN2 of 3 degrees has been found to be successful.

In registration, when the male and female elements are fully engaged, at the groove open ends 45, the transverse dimension between the grooves 43, and the diameter of each groove 43, should be identical to, or very slightly smaller than, the overall transverse width W1 of the male element 101 and the diameter D1 of the side posts 28, respectively, to ensure tight registration. The overall width W1 and diameter D1 should be the maximum dimension of those respective elements' geometries, or very close to them, to ensure that dimensional interference with the grooves does not prevent registration.

In the embodiment shown, both grooves 43 have a partial-cone shape. That is, their transverse cross-sections are open semicircles. Various alternative geometries may be used successfully to provide a means of tapered slidable engagement with the male element. In any case, the male element side posts 28 must have mating geometries providing the engagement described. An essential requirement of the grooves 43 is that the groove surface provide two-dimensional support and stability to an engaged side post 28, and allow slidable engagement in a third, orthogonal, direction. The grooves 43 need not be tapered if a gap angle AN3 is provided to allow the side posts 28 to engage the grooves as described.

In the embodiment illustrated, the center axes of the two grooves 43, and the centerline of the registration surface 44, and the midplane of the male element 101 are all in a common longitudinal plane. This geometry is convenient for manufacturing, and preferred in use, but not essential. Alternatively, the grooves 43 and registration surface 44 may lay outside the plane of the male element CB 24, so long as the side posts 28 and leading edge surface 31 can mate to allow engagement and registration. A critical relationship is that axes of the grooves lay in a single plane and that plane is parallel to the plane of the registration surface normal. This defines how the leading edge surface of the male element will approach and contact the registration surface.

Figure 6B:
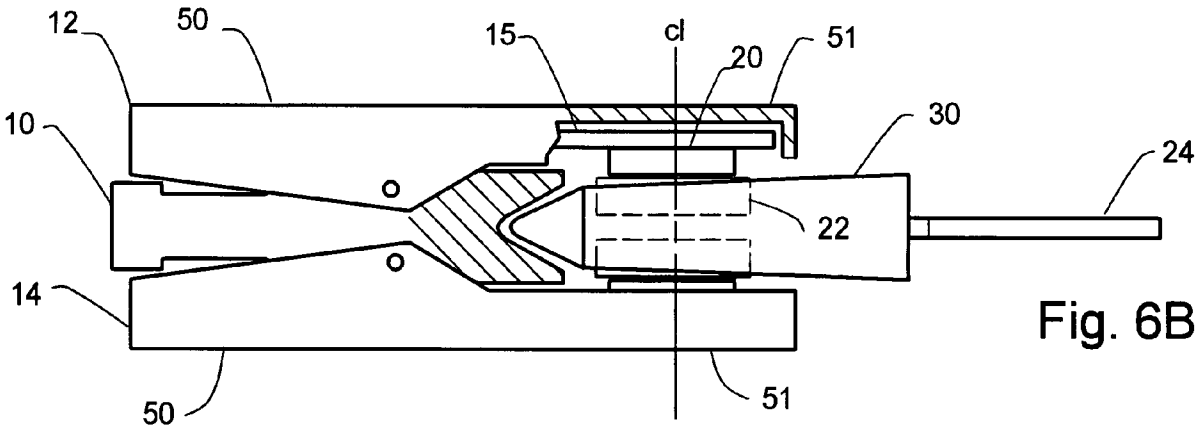
FIGS. 6A and 6B are side section views of the inventive device showing two distinct engagement conditions.
Figure 6A:
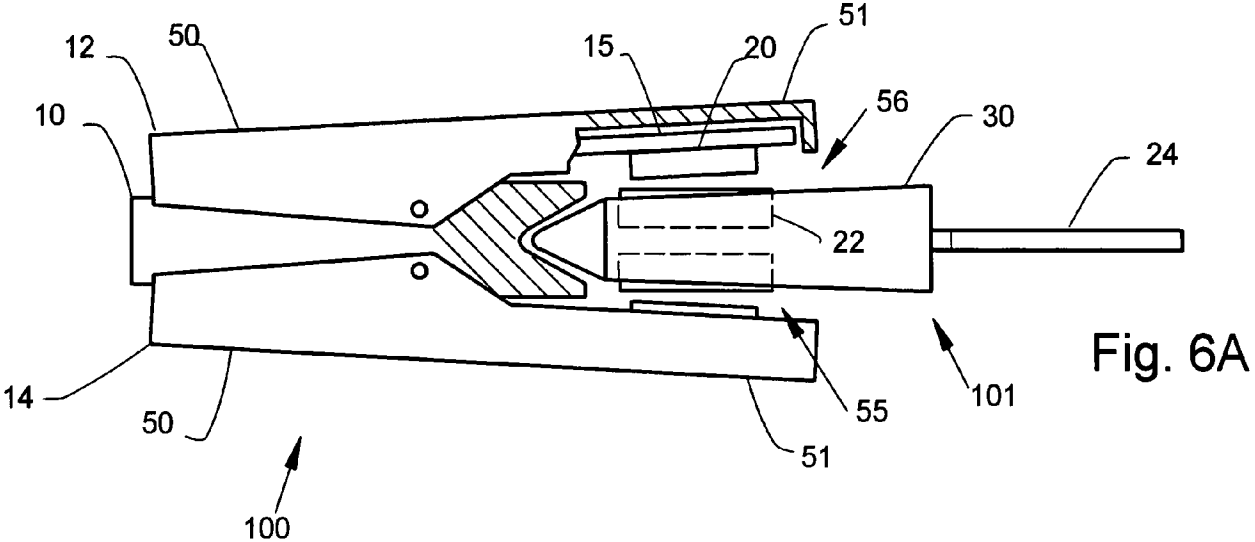

FIGS. 6A and 6B depict the engaged conditions of the device. In the figures, the registration frame arm elements 40 have been cut away to enable viewing of the elements of discussion. For convenience of discussion, the end portions of the upper and lower frame 12, 14, separated by their respective pivot axes, will be called the handle ends 50 and active ends 51. The active ends 51 are associated with and aligned with the connecting elements. In preparation for joining the female and male elements 100, 101, the active ends 51 of the upper and lower frames are moved apart by squeezing together the handle ends 50 to form the open condition shown in FIG. 6A. Once the male element 101 is engaged and in registration, the active ends 51 are squeezed to bring the snap connector elements together in the closed condition seen in FIG. 6B. At the point where the female snap connectors 20 first touch the snap connector portions 22 on the male element 101, the retained CBs 15 must be effectively parallel in this condition to allow the snap connectors portions to join. Applying opposing forces to the active ends 51, in line with the common centerline CL of the snap connectors, will then join them without a net force or torque being transferred to the male element 101.

The location of the snap connector element on one side of the male element need not be in-line with that on the other side of the male element so long as both may be aligned with a respective connector portion on the female element 100. However, nonalignment of the two male connector portions 22 may result in an undesirable net torque produced in the male element 101.

Each pair of mating snap connectors 20, 22 must be aligned within very close tolerance to join. Typically, with the high conductor density devices required in this invention, tolerances are in the range of 0.1 to 0.3 mm (millimeter). This requires tight control of tolerances in manufacture and assembly of the frames and placement of the snap connector portions. A preferred method of fabrication is discussed below.

In order to separate and release joined male and female connector elements, the two handle portions 50 of the upper and lower frames are moved together—pivoting the respective frames. Again, to ensure no net forces or moments are generated and transmitted to the male element 101, the handle portions 50 are preferably parallel to each other.

To ensure that both snap connectors are separated during disengagement, the registration frame 10 is used to limit pivot rotation of both the upper and lower frames 12, 14. When one snap connector releases, the associated frame (upper or lower) is allowed to rotate slightly further with respect to the registration frame 10. However, this rotation is limited by contact between the handle end 50 of the associated frame and the registration frame 10. At this point, further movement of the upper and lower frame handle ends together will force the other frame to rotate, thereby quickly separating the second snap connector as well. In this way, both snap connectors will be assured of being released. Without use of the registration frame 10 as a frame rotation "stop" in this manner, it would be possible that the handle ends are fully forced together while releasing only one of the two snap connectors. Such a symmetric release of both snap connectors as provided by the invention also ensures that the forces on the handle portions are balanced and no net force is transmitted to the male element 101.

The active ends of the upper and lower frames 12, 14 are located, and move between, the two registration frame arms 40. These four elements in the open condition (FIG. 6A) form a tapered receptacle for receiving the male element 101. In the open condition, the opening 56 of this receptacle 55 is significantly larger than the male element 101 at the leading edge 29 making is easy for a user to introduce the male element 101 between the upper and lower frames 12, 14. This allows a user to engage the elements, even blindly, with little manipulation of the devices, thereby reducing the potential of incidental forces being applied to any connection with a subject animal.

It is important to the successful use of the present device that the open condition of the active ends 51 be maintained without user effort before engagement (see FIG. 5). To ensure that this configuration is maintained at the time a user attempts initial engagement, the three frames are configured to bias the active ends 51 apart in the open condition. This is accomplished by providing an "over-center" pivoting action between both the upper and lower frames 12, 14 and the register frame 10. An elongated pivot rod 50 resides in each of two parallel transverse bores in the registration frame 10. The ends of the rods 50 extend beyond the registration frame 10, to engage holes in the upper and lower frames 12, 14. This provides the pivoting connection of these elements. In line with the bore, the registration frame includes a raised over-center ridge 52 (FIGS. 1 and 4) that is configured to contact the respective frame or retained CBs 15 with an interference fit. In this way, the upper and lower frames 12, 14 are biased to pivot on one side, or the other, of parallel to the registration frame and the grooves 43. The result is that once the handle portions 50 are moved together, the active portions 51 will remain spaced apart until actively biased together.

Figure 7:
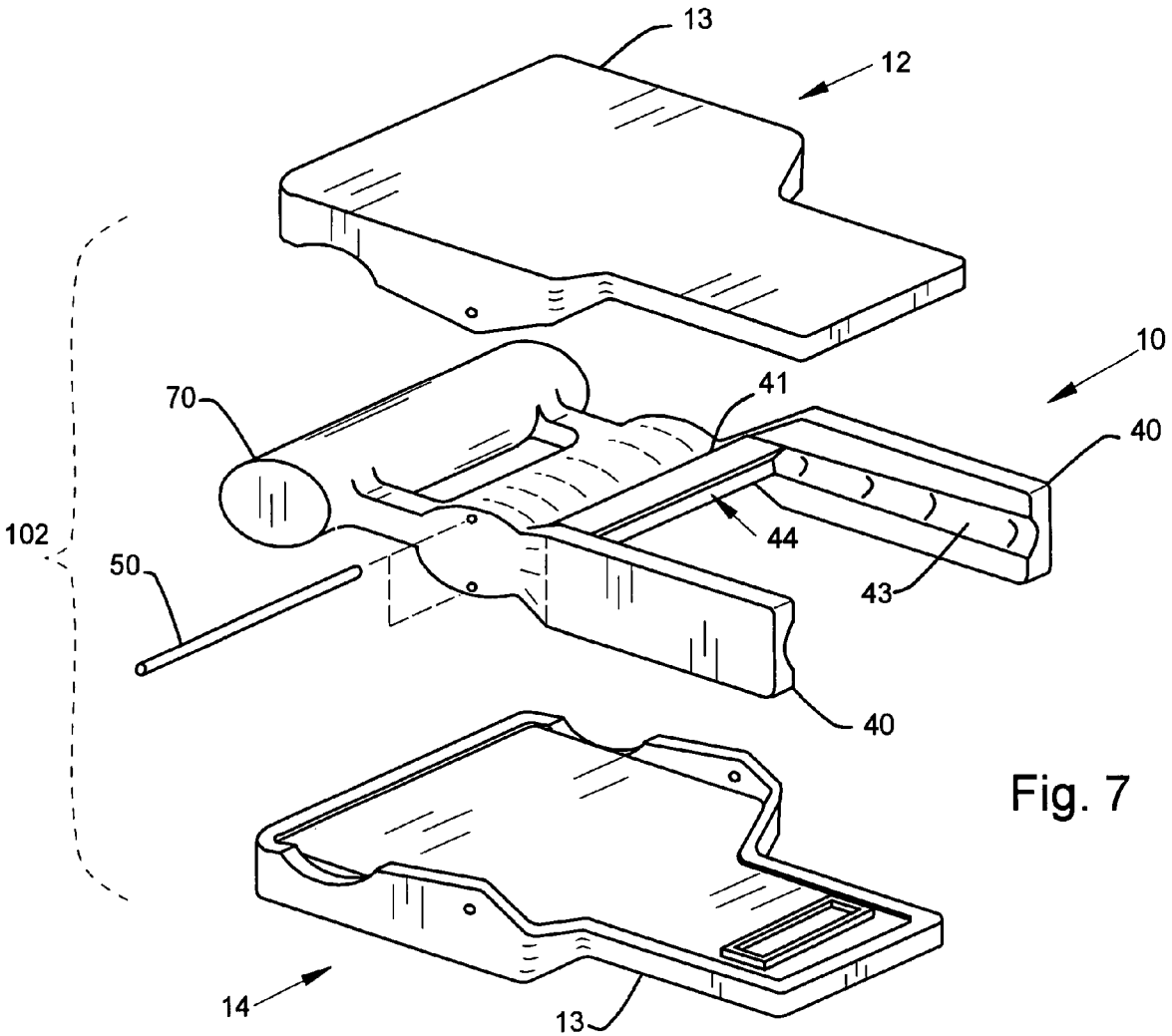
FIG. 7 is an exploded perspective view of an alternative embodiment of the female connector element of the device.

FIG. 7 illustrates an alternative female element 102 in which the registration frame 10, upper frame 12 and lower frame 14 have been modified, from that detailed above, to enhance the symmetric release operation discussed above. The registration frame 10 includes an enlarged stop 70 positioned between the handle end portions of the upper and lower frames 12, 14. In this configuration, the stop 70 is a transverse bar of generally oval cross-section. Its larger height, relative to the distance between the upper and lower frames 12, 14 provides better control of the pivoting range of these frames to ensure symmetric release as discussed. The upper and lower frames 12, 14 are modified to mate with the shape of the stop to provide a maximum of contact surface. The particular cross-section shape of the stop 70 is not critical and may be altered and still provide the same function.

In the embodiments illustrated, the leading edge portion 29 and registration surface 44 are both straight and mutually parallel. However, other geometries will provide the same function. For example, the leading edge portion may include an off-center registration post configured to mate with a registration counterbore in the registration surface. These elements can provide assurance of proper side matching of the male and female elements 100, 101.

In the embodiment of FIG. 1, each retained CB 15 may have connected wire leads to connect to associated application system components. These leads are preferably bundled to pass through a wire tunnel 62 provided in an aft portion 63 of the registration frame 10. This allows the wire leads to pass between the handle portions 50 in all operating conditions. Alternatively, the associated wire leads may exit both from the upper and lower frames, respectively; which configuration reduces the potential of work hardening and breaking the leads at this point. This configuration may be used to advantage in the embodiment of FIG. 7.

Because the high density snap connectors used here have close positional tolerances, relative to other connector types, small dimensional tolerances in manufacture of the frame elements and assembly must be met to ensure fit. Prototype frame elements were successfully fabricated using jet deposition printing of hardenable materials. Fabricating equipment sold by Objet Geometries Inc. company, such as the device sold under the name Eden 250 3-D, provides adequate dimensional control using light hardenable photopolymer materials.

In many applications, it is desired to include active electronic elements, such as operational amplifiers near the snap connectors. These may be incorporated in or on the retained CBs 15, and the covers 13 shaped to provide a cavity to accommodate the devices between the retained CB 15 and the cover 13.

Herein, the elements termed a circuit board may take many forms including a conventional single or multi-layer printed circuit board. Typically, multiple wire leads extend from the circuit boards to transmit signals to external system elements in conventional fashion. Other alternative structures providing the same functions as the circuit board may be used and herein the term "circuit board" and the like are intended to include these alternatives. Similarly, the structure and function of the frame circuit boards may be integrated into the frames themselves. In this alternative, the snap connector elements 20 are secured directly to the upper and lower frames 12, 14. Circuit elements such as wire leads or conductive films are integrated into, or secured to, the frames (rather than the circuit boards) and provide means of connecting or transmitting signals from the snap connectors and frames.

Herein, the term "connector" means a device providing releaseable, electrically conductive, contacts to join two sets of mating electrical circuit elements in a manner that allows repeated joining and separation of the circuit elements. The term "snap connector" is used herein to indicate a multi-channel electrical connector of at least two parts that join, and are held together by an interference fit of their mating surfaces. It may be possible to integrate the snap connector structure and function into a circuit board or like component. Such a device, if available, could be used to replace the separate elements if the other requirements of the invention are satisfied.

Herein, the terms "top" and "bottom" and similar directional words are used for convenience to indicate relative directions and locations and do not limit the absolute positioning of the inventive devices.

Herein, the terms "male" and "female" are meant to indicate respective mating elements and do not define any particular structural limitations otherwise. With respect to conventional elements, such as the snap connectors, the respective so named elements may be interchanged so long as mutually connectable elements are joined in use, unless specified otherwise herein.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. An electrical connector comprising:

a rigid registration frame having:

a register surface and two arms extending in a longitudinal direction from the registration surface, and each arm having a tapered longitudinal groove;

an upper and a lower frame, each having an handle end and an opposite active end, both the upper and lower frames pivotably connected, between their respective ends, to the registration frame, with both active ends located between the two arms;

the two active ends diverging from the registration surface in an open first condition to form, together with the arms, a tapered receptacle;

a first and a second circuit board, each circuit board having a respective snap connector element, and the first circuit board secured to the upper frame and the second circuit board secured to the lower frame with the respective snap connector portions oriented between the circuit boards and located between the arms;

the two circuit boards parallel in a second condition;

a male element comprising:

a leading edge, opposing side posts extending from the leading edge, and two planar sides extending between the side posts; and two male element snap connector portions, each configured to connect with a respective circuit board snap connector portion, and each male element snap connector secured to a respective planar side;

the male element sized and shaped to enter the tapered receptacle while the side posts engage respective grooves; such that, with the leading edge contacting the registration surface to position the male element in the second condition, the two active ends may be biased together to pivot the two frames and connect the circuit board snap connectors with respective male element snap connector portions.

2. An electrical connector, according to claim 1, and further comprising:

a biasing means for biasing the two frames into the open condition.

3. An electrical connector, according to claim 1, and wherein:

each groove has a conical shape with a half-cone angle and each side post has a longitudinal draft angle; and difference between the draft angle and the half-cone angle is in the range of 0.5 to 1.5 degrees.

4. An electrical connector, according to claim 1, and wherein:

the male element comprises an elongated circuit board and a hood frame secured to one end of the elongated circuit board;

the hood frame including the side posts and leading edge.

5. An electrical connector, according to claim 4, and wherein:

the male element has a conductor surface density of at least 60 conductors per linear.

6. An electrical connector, according to claim 5, and wherein:

the snap connector is a surface-mounted device.

7. An electrical connector comprising:

a registration frame base having a registration surface with a surface normal in a longitudinal axis direction;

two parallel arms spaced apart and extending rigidly from the registration frame base in the longitudinal direction, each having a tapered longitudinal groove with a taper angle;

an upper frame having a handle end and active end and pivotably secured, between its two ends, to the registration frame base;

a lower frame having a handle end and active end and pivotably secured, between its two ends, to the registration frame base;

the two frames spaced apart and pivoting about parallel axes;

a male element comprising:

a leading edge, two opposing side posts, each side post extending from the leading edge with a draft angle greater than the taper angle, and two planar sides extending between the side posts, the planar sides each having a respective multiple electrical contacts and circuit elements extending therefrom;

the male element received, in a registered condition, between the lower and upper frames, the leading edge contacting the registration surface, and both side posts slideably disposed within respective arm grooves;

the active ends of the lower and upper frames sufficiently spaced apart, in an open condition to allow insertion of the male element there between;

connection means for electrically connecting both frames with the male element circuit contacts when the two active end are biased together against the male element in the registered condition; and transmission means for transmitting electrical signals from the frames.

8. An electrical connector, according to claim 7, and wherein:

the connection means comprises two snap connectors, each having mating portions secured to respectively facing frames and male element sides.

9. An electrical connector, according to claim 7, and wherein:

the transmission means comprises: surface conductors integrated into the respective frames and connected to the frame snap connectors, and wire leads connected to the conductors and extending from the frames.

10. An electrical connector, according to claim 7, and wherein:

the male element comprises a planar circuit board having an end, and a frame secured to the end; the frame comprising the leading edge and side posts.

11. An electrical connector, according to claim 7, and wherein:

each frame comprises: a planar circuit board and a rigid cover secured to the circuit board, the respective snap connector portion surface-mounted to the circuit board.

12. An electrical connector comprising:

a rigid base an upper frame having a handle end and active end and pivotably secured, between its two ends, to the base;

a lower frame having a handle end and active end and pivotably secured, between its two ends, to the base;

the two frames spaced apart to form an separating gap;

each frame having a respective female electrical connector portion aligned with its respective active end and extending into the gap;

a circuit board having planar sides, an end, and parallel edges extending from the end;

a hood frame secured to the circuit board end and having a leading edge and tapered side posts extending from the leading edge and over the sides;

two male electrical snap connectors portions, each secured to a respective planar side between the side posts;

engagement means for receiving and retaining the circuit board in the gap to define an registration condition, such that when the active ends are biased together, each female connector portion mates with a respective male connectors portion in a joined condition;

the frames configured such that when the handle ends are biased together in the joined condition, the mated connector portions are disconnected;

transmission means for transmitting electrical signals from the snap connectors.

* * * * *